US008287103B2

(12) United States Patent
Saito et al.

(10) Patent No.: US 8,287,103 B2
(45) Date of Patent: Oct. 16, 2012

(54) INK JET PRINT HEAD

(75) Inventors: Akiko Saito, Tokyo (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/473,825

(22) Filed: May 17, 2012

(65) Prior Publication Data

US 2012/0224006 A1 Sep. 6, 2012

Related U.S. Application Data

(62) Division of application No. 12/691,160, filed on Jan. 21, 2010, now Pat. No. 8,201,925.

(30) Foreign Application Priority Data

Feb. 6, 2009 (JP) ..... 2009-026170

(51) Int. Cl.
*B41J 2/05* (2006.01)

(52) U.S. Cl. ..... 347/65; 347/40; 347/43

(58) Field of Classification Search ..... 347/20, 347/40, 42–44, 47, 56, 61–65, 92–94, 84–87
See application file for complete search history.

(56) References Cited

U.S. PATENT DOCUMENTS

| | | | | |
|---|---|---|---|---|
| 6,557,983 | B1 * | 5/2003 | Inoue | 347/65 |
| 6,607,259 | B2 | 8/2003 | Mott et al. | |
| 6,830,317 | B2 | 12/2004 | Tsuchii et al. | |
| 6,926,391 | B2 * | 8/2005 | Yang et al. | 347/65 |
| 6,976,748 | B2 | 12/2005 | Yabe et al. | |
| 6,981,760 | B2 | 1/2006 | Yamamoto | |
| 7,591,531 | B2 | 9/2009 | Tsuchii et al. | |
| 2009/0058933 | A1 | 3/2009 | Matsumoto et al. | |
| 2009/0231394 | A1 | 9/2009 | Inoue et al. | |

FOREIGN PATENT DOCUMENTS

| | | | |
|---|---|---|---|
| CN | 101195301 | A | 6/2008 |
| JP | 10-157116 | A | 6/1998 |
| JP | 10-181021 | A | 7/1998 |
| JP | 2003-118124 | A | 4/2003 |
| JP | 2003-170597 | A | 6/2003 |

* cited by examiner

*Primary Examiner* — Juanita D Jackson
(74) *Attorney, Agent, or Firm* — Fitzpatrick, Cella, Harper & Scinto

(57) ABSTRACT

An ink jet print head is provided which has a reduced size and still can prevent an overall temperature increase in a printing element board. To this end, among ink supply port arrays formed on both sides of each nozzle array, the heat resistance of the portion (beams) of the printing element board between the adjoining ink supply ports is lowered in those arrays that are close to the end portions of the common liquid chamber.

10 Claims, 11 Drawing Sheets

INK JET PRINT HEAD

CROSS REFERENCE TO RELATED APPLICATION

This application is a division of U.S. patent application Ser. No. 12/691,160, filed Jan. 21, 2010 now U.S. Pat. No. 8,201,925. The entire disclosure of the earlier application is hereby incorporated by reference herein.

BACKGROUND OF THE INVENTION

1. Field of the Invention

The present invention relates to an ink jet print head that ejects ink onto a print medium to perform printing.

2. Description of the Related Art

Ink jet printing systems are in wide use today not only due to their ability to print highly defined images at high speeds, but also due to their ability to perform printing on even a print medium not subjected to special treatments. Ink jet print heads that actualize these ink jet printing systems have various types of ejection systems, which are typified by the use of the energy of heat-generated bubbles to eject ink, or the use of piezoelectric elements.

In recent years, with respect to such ink jet print heads, there has been a growing demand for higher print quality and faster printing speed. Means that have been proposed to increase the printing speed include increasing the number of nozzles in the ink jet print head and improving the ejection frequency.

One of the factors that determines the upper limit of the ejection frequency of an ink jet print head is the time it takes for a nozzle, after ejecting ink, to be supplied and filled with ink again (also referred to as refill time). The shorter this refill time becomes, the higher the ejection frequency will be at which the printing can be performed.

FIG. 11 is a partially cut-away cross section view showing the interior of a conventional print head. In a conventional nozzle structure, which supplies ink from a single ink supply port 95 opening along arrays of nozzles through only one ink path 97 into pressure chambers 96, the refill time is dictated by the flow resistance of the ink flow path. As a means to reduce the refill time, Japanese Patent Laid-Open No. H10-181021 (1998) discloses a technique that arranges flow path walls so as to form a plurality of flow paths in each of the pressure chambers, thereby increasing the number of ink inflow paths.

To obtain highly defined, deep-grayscale, high-quality printed images, there are currently demands for an ink jet print head which has low variation in the ejection volume of any particular nozzle, and low variation among the different nozzles in the print head. Regarding ink jet print heads that eject ink via the force of an expanding bubble, however, the amount of ink ejected changes with the temperature near the ejection opening. Particularly when there is a local temperature distribution within the nozzle array, the ink ejection volume varies according to the temperature distribution, resulting in a printed image having density variations and therefore a degraded image quality. Although, to deal with this situation, a variety of measures have been taken on the ink jet printing apparatus body side, such as multi-path techniques and drive pulse control, the stabilization of the ink ejection volume depends largely on the stand alone performance of the ink jet print head.

Japanese Patent Laid-Open No. H10-157116 (1998) discloses a technique to reduce printing variations that makes the temperature near the end of the print head and the temperature near the central portion thereof almost equal by the provision of heat dissipating fins at the center of the print head.

To minimize image quality degradations caused by an increase in temperature distribution of an ink jet print head, Japanese Patent Laid-Open No. 2003-170597 discloses a technique that introduces a heat conductive film into a print head board and connects it to a heat dissipating portion that dissipates heat to the ink, thereby suppressing the overall temperature rise. Japanese Patent Laid-Open No. 2003-118124 discloses a technique that cools the print head board itself via an ink flow supplied to the print head.

The conventional ink jet print head has a single ink supply port opening along the nozzle arrays, as shown in FIG. 11. In this configuration, pressure generated in the pressure chamber 96 by an expanding bubble escapes toward the ink path 97, with the result that the generated pressure may not be fully utilized for ink ejection. Since the pressure escapes toward the ink path 97, the ejected ink may stray from the intended direction.

Further, in the conventional configuration, heat generated by a heating resistor is transmitted through the print head board and dissipated outside the nozzle arrays. This is because the portion where the ink supply port is provided constitutes a heat insulating portion, allowing the heat generated by the heating resistor only to escape toward the outside of the nozzle arrays. This configuration makes it difficult for heat to escape. A local temperature rise in the print head board may be reduced by widening the interval between the heating resistors to increase the heat escape path. In that case, the print head board becomes large in size.

SUMMARY OF THE INVENTION

It is therefore an object of the invention to provide an ink jet print head that can reduce the size of the print head while suppressing the overall temperature rise of the print head board.

The ink jet print head of the present invention comprises a common liquid chamber formed on a first surface of a print head board, ink supply ports through which ink is supplied from the common liquid chamber to nozzles, heating resistors installed on a second surface, opposite the first surface, of the print head board, a plurality of arrays of the nozzles capable of ejecting ink from their ejection openings by energizing the heating resistors, and a plurality of arrays of the ink supply ports, wherein the plurality of nozzle arrays include a first nozzle array situated on an end portion side of the common liquid chamber and a second nozzle array situated on a central side of the common liquid chamber, wherein the plurality of ink supply port arrays include a first ink supply port array formed along at least one nozzle array and situated on an end portion side of the common liquid chamber and a second ink supply port array situated on a central side of the common liquid chamber, wherein either the first nozzle array or the second nozzle array is situated between the first ink supply port array and the second ink supply port array, and wherein a heat resistance of a portion of the print head board situated between the adjoining ink supply ports in the first ink supply port array is smaller than a heat resistance of a portion of the print head board situated between the adjoining ink supply ports in the second ink supply port array.

According to the invention, a plurality of nozzle arrays include a first nozzle array situated on an end portion side of a common liquid chamber and a second nozzle array situated on a central side of the common liquid chamber. As for ink supply ports, a first ink supply port array formed along a nozzle array and situated on an end portion side of the common liquid chamber and a second ink supply port array situated on a central side of the common liquid chamber are included. Either the first nozzle array or the second nozzle array is situated between the first ink supply port array and the second ink supply port array. The portion of the print head board situated between adjoining ink supply ports in the first ink supply port array has a smaller heat resistance than the portion of the print head board situated between adjoining ink supply ports in the second ink supply port array.

This arrangement has actualized an ink jet print head that can have a reduced size yet still prevent the overall temperature of the printing element board from rising.

Further features of the present invention will become apparent from the following description of exemplary embodiments (with reference to the attached drawings).

DESCRIPTION OF THE EMBODIMENTS

First Embodiment

Now, a first embodiment of the invention will be described with reference to the accompanying drawings.

Figure 1:
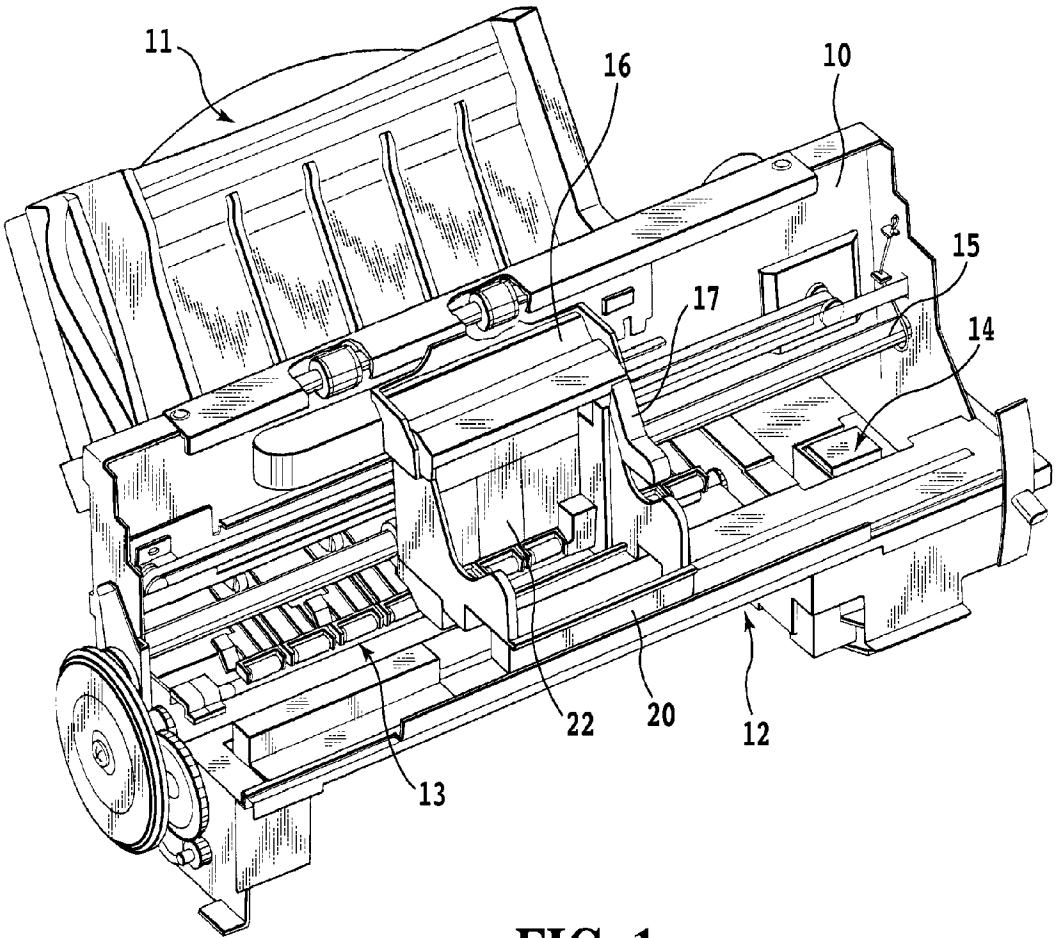
FIG. 1 is an external view of a mechanical construction of an ink jet printing apparatus of one embodiment of this invention.
Figure 2:
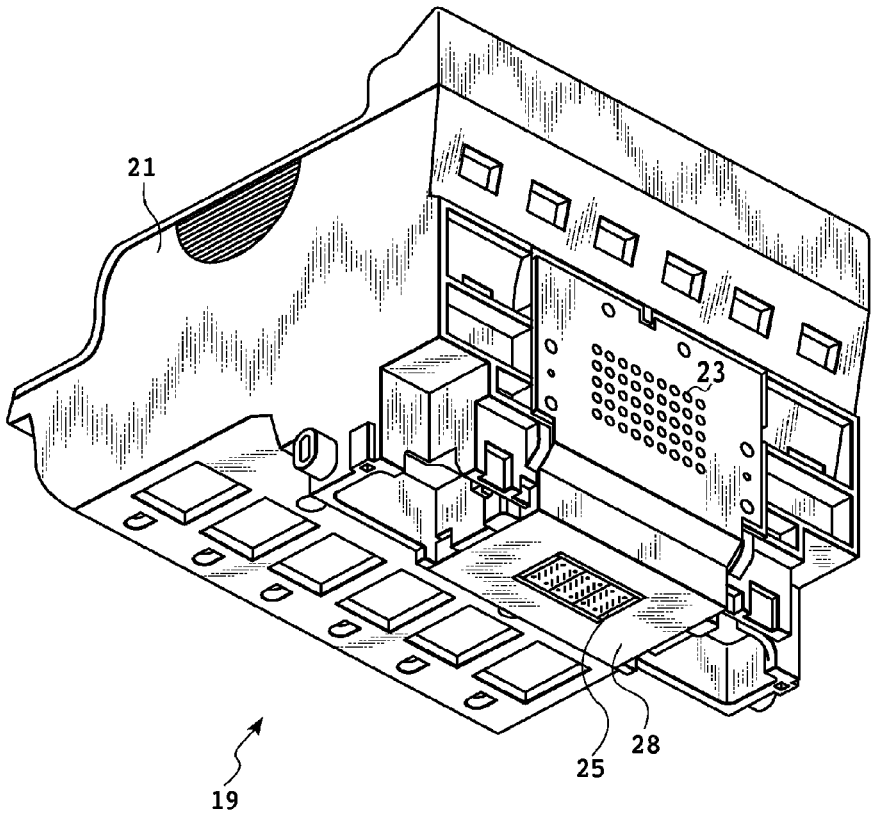
FIG. 2 is an external view of a head cartridge used in the ink jet printing apparatus of the embodiment.
Figure 3:
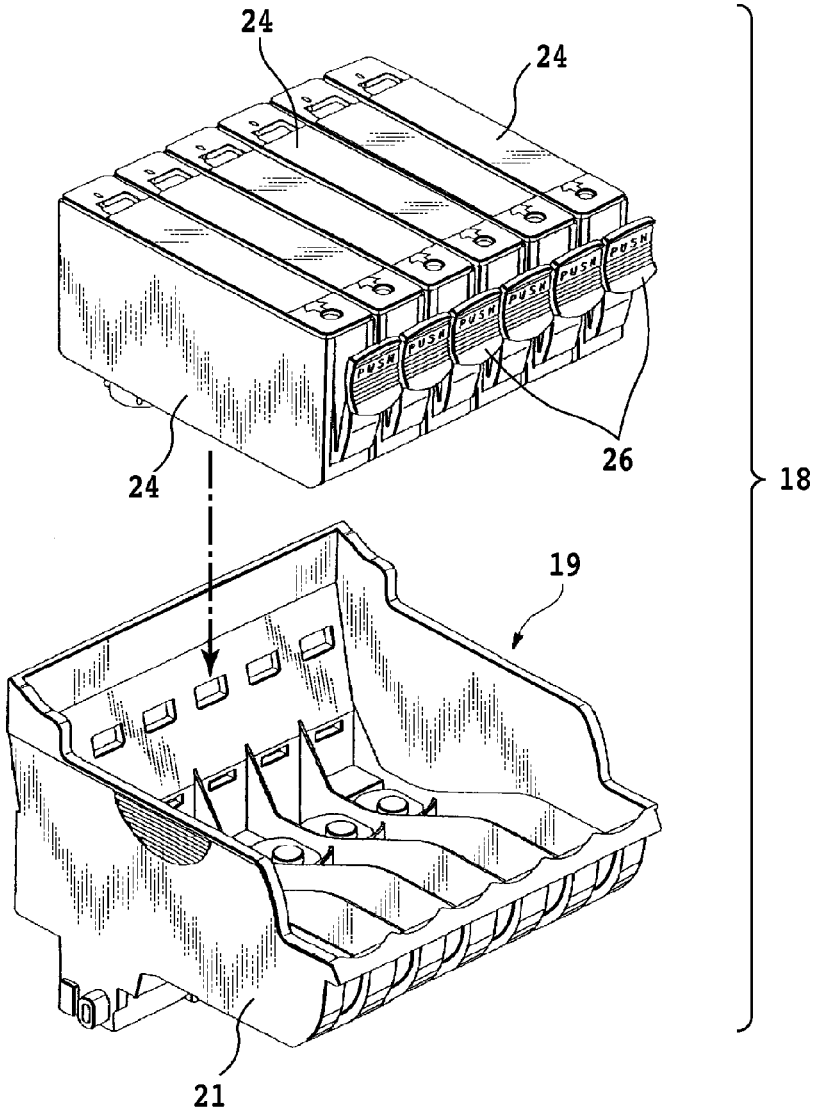
FIG. 3 is an external view of a print head.

FIG. 1 shows an external view of the mechanical structure of an ink jet printing apparatus of this embodiment, FIG. 2 shows an external view of a head cartridge used in this ink jet printing apparatus and FIG. 3 shows an external view of a print head of the head cartridge. A chassis 10 of the ink jet printing apparatus in this embodiment comprises a plurality of plate-like metal members with a predetermined rigidity. The chassis 10 has a print medium feed unit 11 to automatically feed a sheet of print medium (not shown) into the interior of the ink jet printing apparatus. The chassis 10 also has a medium transport unit 13 for moving the print medium supplied from the print medium feed unit 11 to a desired print position and further moving it from the print position to a medium discharge unit 12, a print unit for executing a predetermined print operation on the print medium at the print position and a head recovery unit 14 for executing an ejection performance recovery operation on the print unit.

The print unit comprises a carriage 16 supported such that it can be moved along a carriage shaft 15 and a head cartridge 18 removably mounted in this carriage 16 through a head set lever 17.

The carriage 16 in which the head cartridge 18 is mounted is provided with a carriage cover 20 that positions an ink jet print head 19 (also referred to simply as a print head) at a predetermined mounting position on the carriage 16. The carriage 16 is also provided with the head set lever 17 that engages with a tank holder 21 of the print head 19 to push and position the print head 19 at the predetermined mounting position. The head set lever 17 for fixing and removing the print head is pivotally mounted on a head set lever shaft (not shown) on the top of the carriage 16. The carriage 16 also has at its engagement portion with the print head 19 a spring-biased head set plate (not shown), which by its spring force presses the print head 19 against the carriage 16 for secure mounting of the print head.

A contact flexible print cable (or simply referred to as a contact FPC) 22 is connected at one end to the carriage 16 at another engagement portion with the print head 19. When a contact portion, not shown, formed at one end of the contact FPC 22 comes into electrical contact with a contact portion 23 of the print head 19, which serves as an external signal input terminal, various pieces of information for printing, and electricity are supplied to the print head 19.

Between the contact portion of the contact FPC 22 and the carriage 16 is installed an elastic member such as rubber, not shown. The elastic force of the elastic member and the pressing force of the head set plate combine to ensure a reliable connection between the contact portion of the contact FPC 22 and the contact portion 23 of the print head 19. The other end of the contact FPC 22 is connected to a carriage board, not shown, mounted at the back of the carriage 16.

The head cartridge 18 of this embodiment has an ink tank 24 storing ink and the print head 19 that ejects ink supplied from the ink tank 24 from the ejection openings of the print head 19 according to print information. The print head 19 of this embodiment is of a so-called cartridge type that can be removably mounted on the carriage 16.

For photographic high-quality color printing, this embodiment allows the use of six independent ink tanks 24 for black, light cyan, light magenta, cyan, magenta and yellow ink. Each of the ink tanks 24 is provided with an elastically deformable release lever 26 that locks onto the head cartridge 18. By operating the associated release lever 26, individual ink tanks 24 can be removed from the print head 19, as shown in FIG. 3. The release levers 26 therefore function as part of a mounting/dismounting means of this invention. The print head 19 comprises a printing element board described later, an electric wiring board 28 and the tank holder 21. The printing element board is electrically connected to the electric wiring board 28 through contacts at a square hole 25 in the electric wiring board 28.

Figure 4:
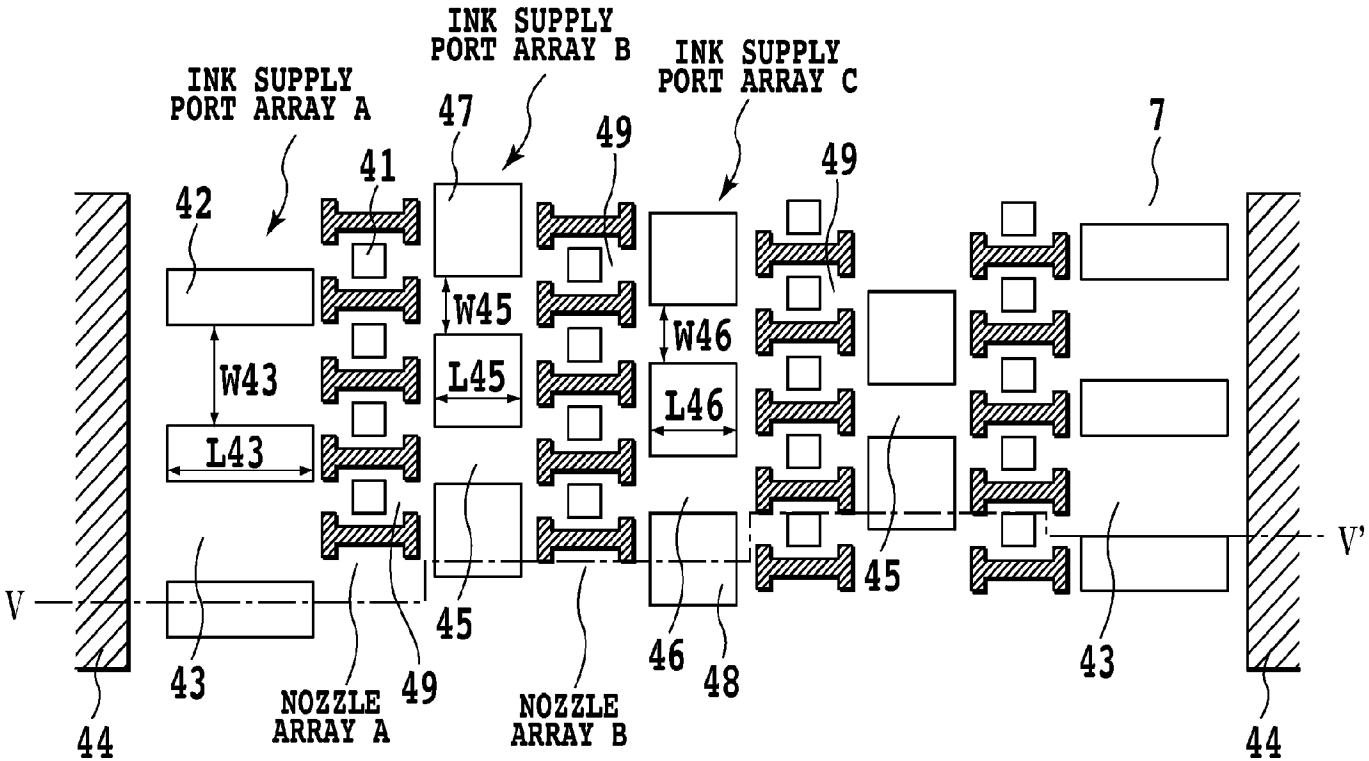
FIG. 4 is a schematic view of nozzle array groups in a print head of the first embodiment of this invention, with one part of a printing element board shown enlarged.

FIG. 4 shows a plurality of nozzle arrays in the print head 19 of the first embodiment of this invention, with one area of the printing element board shown enlarged. In the print head 19 of this embodiment, the printing element board (or simply referred to as a board) 7 is provided with a plurality of heating resistors 41 and nozzles 49. Ink is heated by each of the heating resistors 41 to form a bubble, whose pressure as the bubble expands is used to eject ink from the associated ejection opening. In this embodiment, each heating resistor is formed inside a pressure chamber and the nozzle 49 represents a space ranging from the ejection opening to the pressure chamber.

Figure 11:
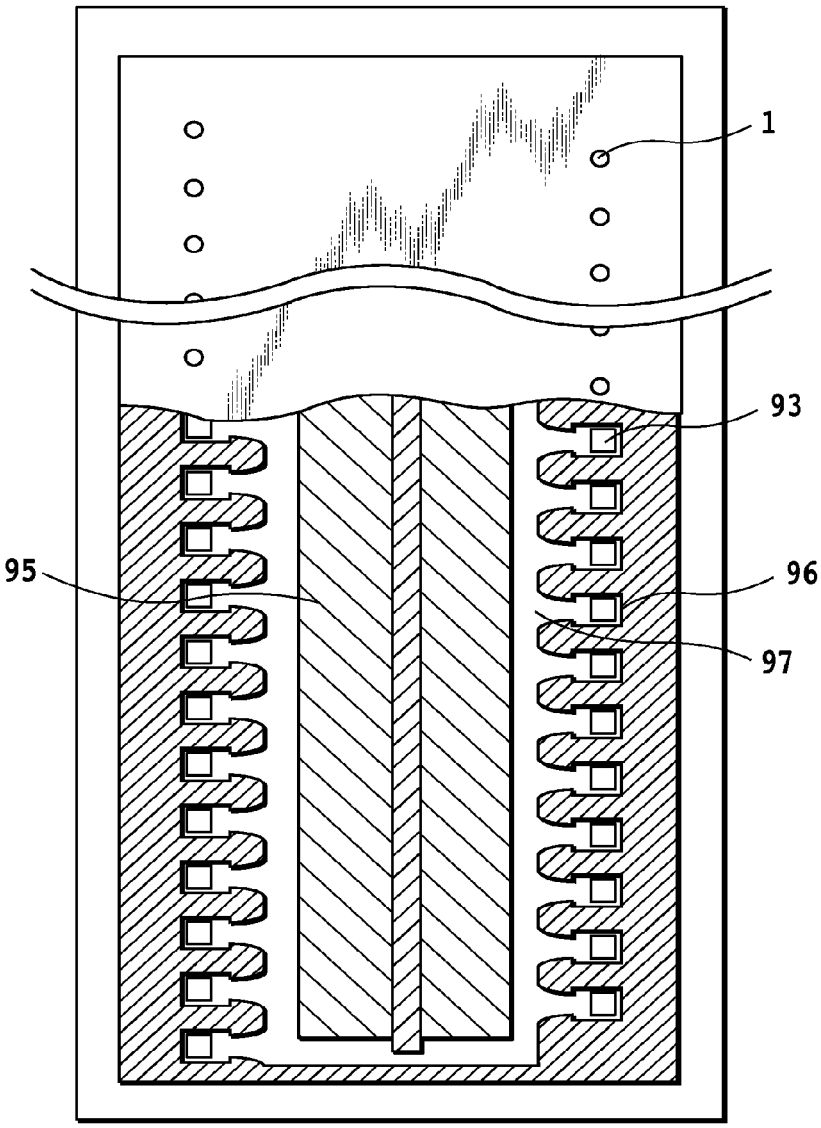
FIG. 11 PRIOR ART
FIG. 11 is a partly cut-away cross-sectional diagram showing the interior of a conventional print head.

In the conventional printing element board such as shown in FIG. 11, each pressure chamber 96 is provided with the ink path 97 on one side only. Because of this configuration, the pressure generated as the bubble is formed may escape toward the ink path 97 side, with the result that the ejected ink may stray from the intended direction, which is perpendicular to the printing element board. To deal with this problem, in the printing element board 7 of this embodiment two ink paths are formed for each nozzle 49 and independent ink supply ports are provided on both sides of the nozzles 49 so that ink is made to flow into each of the nozzles 49 from both sides. In this configuration, the pressure escape during bubble generation is symmetrical with respect to the nozzle 49 such that the ink can be ejected perpendicular to the printing element board 7.

Further, for the same color of ink, the printing element board 7 of this embodiment is provided with four nozzle arrays having a plurality of heating resistors 41 and with five ink supply port arrays arranged on both sides of the nozzle arrays, each ink supply port array comprising a plurality of ink supply ports. Portions 43 in the printing element board that are situated between adjoining ink supply ports 42 (also referred to as beams) in an ink supply port array A (first ink supply port array), exist between a nozzle drive circuit 44 and a nozzle array A (first nozzle array). Similarly, beams 45 in an ink supply port array B (second ink supply port array) exist on the nozzle array group center side of the nozzle array A, between the nozzle array A and a nozzle array B (second nozzle array). Further, beams 46 in an ink supply port array C exist between ink supply ports 48 of the center ink supply port array C.

Figure 5:
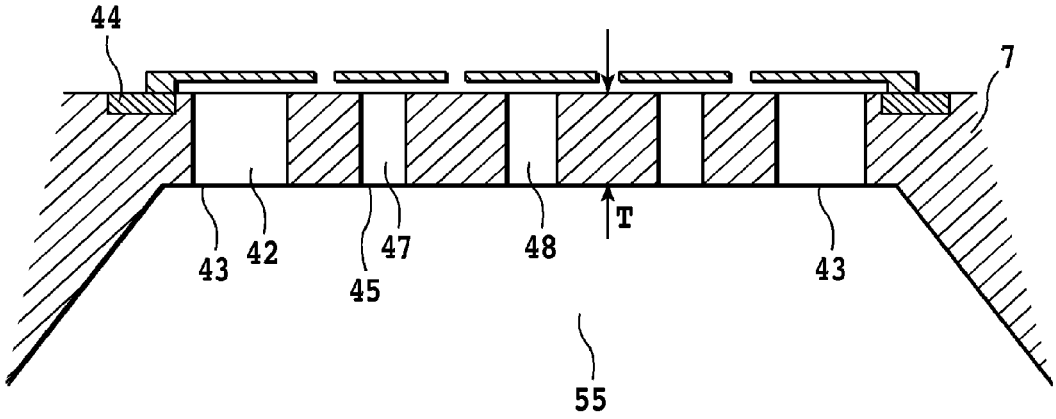
FIG. 5 is a cross section taken along the line V-V' of FIG. 4.

FIG. 5 is a cross section taken along the line V-V' of FIG. 4. The beams in the printing element board between the ink supply ports communicating with a common liquid chamber 55 that is provided on one side of the printing element board 7 are equal in thickness, and this thickness is taken as T. That is, the depths of the ink supply ports are all equal to the thickness T, with ink supplied from the common liquid chamber 55 through the ink supply ports with a depth T to the opposite side of the printing element board.

In this embodiment, the ink supply ports are arranged to establish a heat resistance relationship among the beams such that beam 43<beam 45≦beam 46. More specifically, the arrangement of the ink supply ports is made such that the heat resistances of the beams in each ink supply port array, defined by L/(W×T) where L is the length of the beam and W×T the cross-sectional area of the beam, meet the following relationship:

$$L43/(W43\times T)<L45/(W45\times T)\leqq L46/(W46\times T) \quad \text{(Equation 1).}$$

The heat generated by the heating resistors 41 is transmitted through the beams and released from near the nozzle drive circuit 44 at both sides of the nozzle array group where the board has an increased thickness. That is, the heat is dissipated through the printing element board from both ends of the common liquid chamber provided at the back (when viewed from the front side of FIG. 4) of the printing element board 7. The beam 45 in the ink supply port array B works as a heat dissipating path for the nozzle array B, whereas the beam 43 in the ink supply port array A works as a heat dissipating path for both the nozzle array A and the nozzle array B, so a greater amount of heat passes through the beam 43 than the beam 45.

Figure 6:
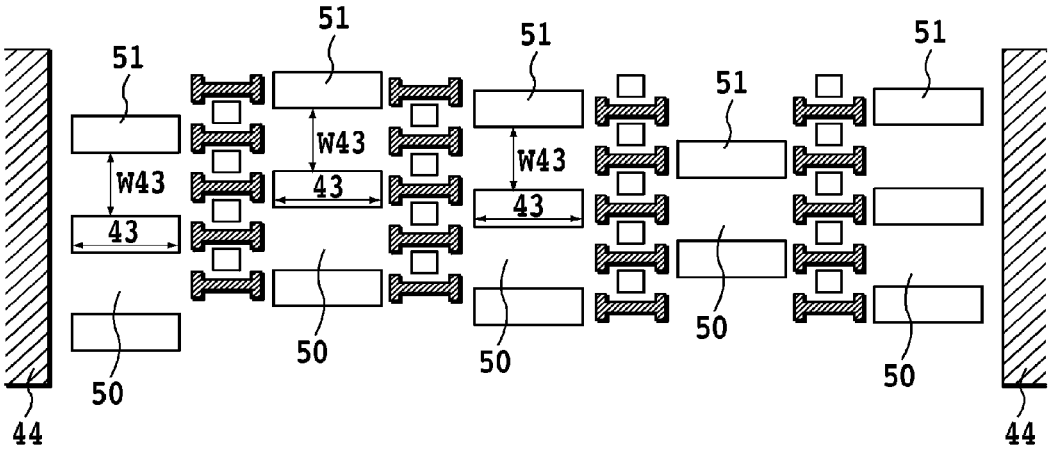
FIG. 6 shows a comparative example with respect to the first embodiment.

FIG. 6 shows a comparative example with respect to this embodiment. This diagram shows enlarged a part of a printing element board in which the ink supply ports are arranged, without considering differences in heat flux among beams, so that a relatively large volume of heat can pass through any of the beams. Although this arrangement of ink supply ports 51 in such a way as to enable any of the beams 50 to pass a relatively large volume of heat has an advantage of improved heat dissipation, there is a disadvantage. That is, since the width of each beam needs to be increased, the opening dimension of the ink supply ports, in the direction that the ink supply port array is aligned, becomes smaller. To ensure the necessary volume of ink supply, the dimension of the ink supply ports, in the direction perpendicular to the direction of ink supply port array needs to be increased, resulting in an increased size of the printing element board itself, which is not desirable.

For this reason, the heat resistance of the path through which a large volume of heat passes, as with the beam 43 of this embodiment, is made relatively small to minimize the temperature rise in the beam 43 caused by heat resistance. In that case, while the individual ink supply ports 42 of the ink supply port array A, in which the beams are formed, become relatively large to ensure a predetermined volume of flow, other ink supply ports can be made relatively small. That is, since the beams 45 through which a relatively small amount of heat passes can be narrowed to a point short of where the temperature rise caused by the heat resistance begins to pose a problem, the overall size of the printing element board 7 can be reduced while at the same time preventing an overall temperature increase.

In this embodiment, nozzles in each nozzle array are arranged at 600 dpi and ink supply ports at 300 dpi. The depth of ink supply ports and the thickness of beams are approximately 100 μm and almost constant throughout the nozzle array group. The opening area of the ink supply ports 42 needs to be more than a predetermined area (2800 $\mu m^2$ or more in this embodiment) in order to meet the intended ink supply performance. If the ink supply ports are arranged to satisfy Equation 1, and the size of the ink supply ports 42 in the array of the beams 43 is (length×width)=70 μm×40 μm, the width of the beams W43=44.5 μm. Again, if the size of the ink supply ports 47 and 48 in the array of beams 45 and 46 is 54 μm×52 μm, the width of beams W45 and W46=32.5 μm.

As described above, among ink supply port arrays formed on both sides of each of the nozzle arrays, the heat resistance of the portion of the printing element board 7 between the ink supply ports (beams) is reduced in those arrays that are situated on the end sides of the printing element board 7 (end sides of the common liquid chamber). This has resulted in an ink jet print head being actualized which has a reduced size of the printing element board with a minimal temperature rise through efficient heat dissipation and which can eject ink perpendicularly therefrom.

Alternative Implementation

Figure 7:
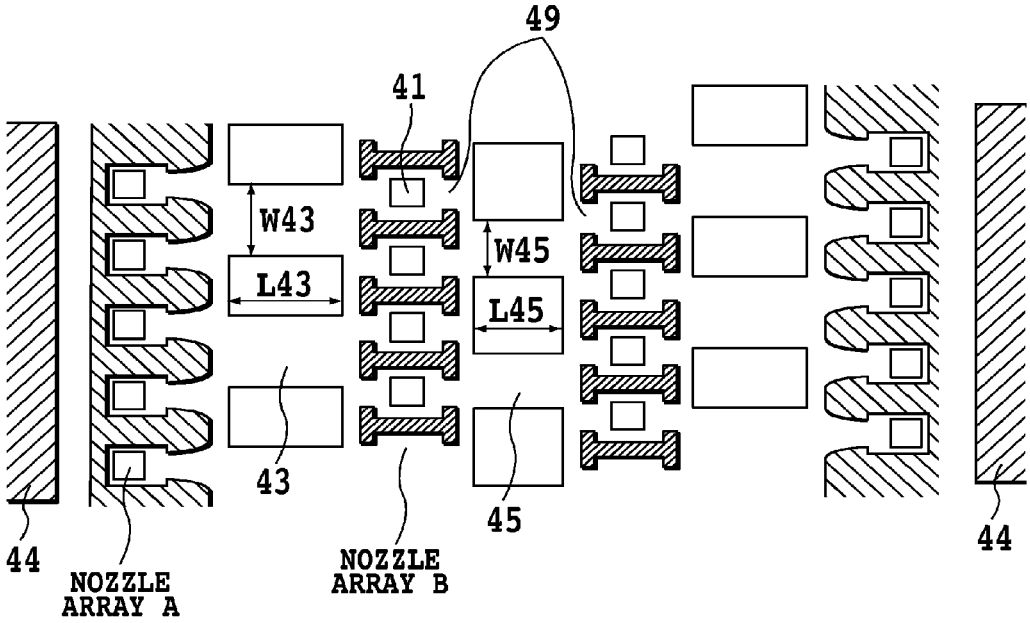
FIG. 7 shows an example of an alternative implementation of the first embodiment.

FIG. 7 shows an example of an alternative implementation of the present embodiment. While in FIG. 4 five ink supply port arrays have been shown, the example of FIG. 7 has only three ink supply port arrays so as to further reduce the size of the print head and reduce costs. In this configuration, the nozzles 49 in the nozzle array A have only one ink flow path. Hence, these nozzles 49 take longer to refill than the nozzles that have two ink flow paths through which ink flows into each nozzle (the nozzles of nozzle array B), slowing the overall print speed of the print head.

However, by utilizing the present invention and arranging the ink supply ports in ways that satisfy Equation 1 (excluding the terms of L46 and W46), the size of the print head can be reduced significantly while minimizing the overall temperature rise in the print head.

If small nozzles with a small ejection volume are to be installed to obtain high-quality images with improved granularity, these small nozzles are positioned in the nozzle array A. Generally, small nozzles with a small ejection volume have a shorter refill time due to their small ejection capacity. The use of small ink nozzles can shorten the refill time of the array A of nozzles with only one ink flow path and therefore prevent the overall print speed of the print head from slowing down as it would if the normal-size nozzles were used.

As described above, in the case of the printing element board having small nozzles with a small ejection volume and capable of producing high-quality images, too, application of the present invention can actualize a reduced size ink jet print head that a minimal overall temperature increase in the printing element board and which can eject ink perpendicularly therefrom.

Second Embodiment

Now, a second embodiment of the invention will be described with reference to the accompanying drawings. The basic configuration of the ink jet print head of this embodiment is similar to the first embodiment, so explanations will be made of only configurations particular to this embodiment.

Figure 8:
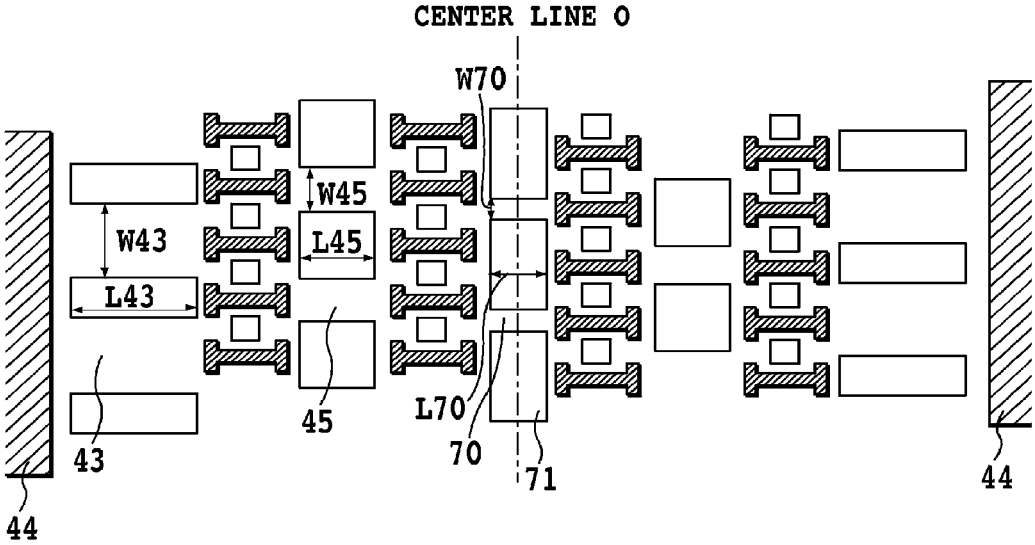
FIG. 8 is a schematic view of nozzle array groups in a print head of a second embodiment of this invention, with one part of a printing element board shown enlarged.

FIG. 8 shows a group of nozzle arrays in a print head 19 of the second embodiment of this invention, with a part of the printing element board shown enlarged. As for the nozzle arrays of the ink jet print head of this embodiment, left and right nozzles are driven almost symmetrically with respect to a center line O during printing. Particularly during printing operations at the high-density portions of an image, where the nozzles get intensively heated, heat is considered dissipated toward the outside of the nozzle arrays. Beams 70 are not in the heat dissipation path and therefore have almost no effect on heat release efficiency. So, as shown in FIG. 8, to further narrow the width W70 of the beams 70, the size of ink supply ports 71 on the center line O is set to 46 μm×60 μm and the width of beams to W70=24.5 μm. This arrangement can actualize an ink jet print head that has a reduced size with a minimal overall temperature rise in the printing element board and which can eject ink perpendicularly therefrom.

(Alternative Implementation)

Figure 9:
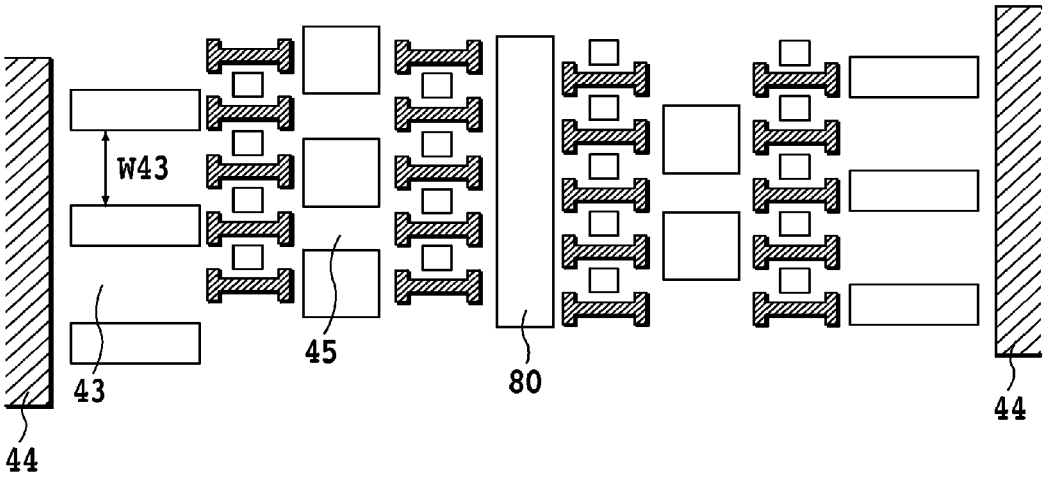
FIG. 9 shows an example of an alternative implementation of the second embodiment.

FIG. 9 shows an example of an alternative implementation of this embodiment. The central ink supply port 80 is made a continuous port having no beam at all in order to reduce the size of the printing element board while at the same time meeting the required ink supply performance. As for the beams 43 and 45, which constitute the heat dissipation paths, the width W43 of the beam 43 is increased to meet Equation 1 of the first embodiment. This enables the realization of an ink jet print head that has a reduced size with a minimal overall temperature rise in the printing element board and which can eject ink perpendicularly therefrom.

Third Embodiment

Now a third embodiment of the invention will be described with reference to the accompanying drawings. The basic configuration of the ink jet print head of this embodiment is similar to the first embodiment, so only configurations particular to this embodiment will be explained.

Figure 10:
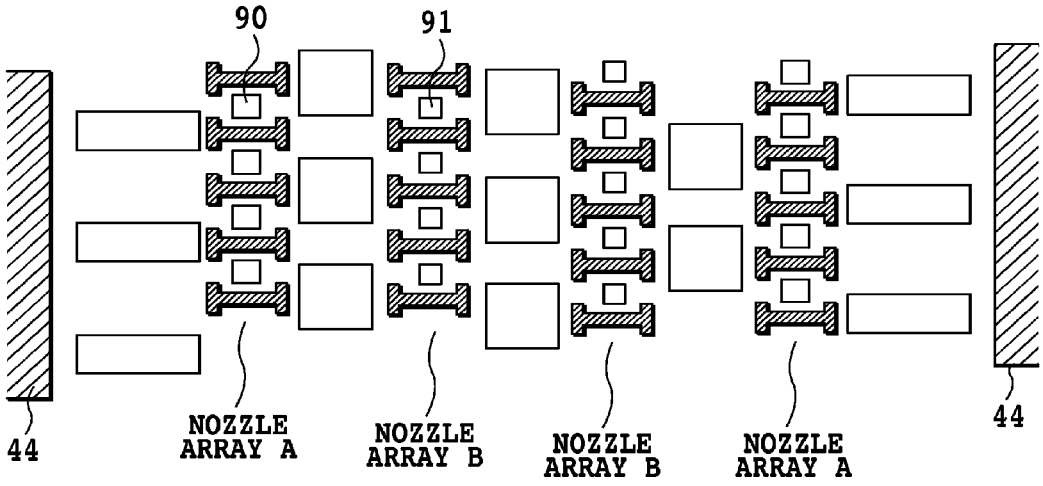
FIG. 10 is a schematic view of nozzle array groups in a print head of a third embodiment of this invention, with one part of a printing element board shown enlarged.

FIG. 10 shows a group of nozzle arrays in a print head 19 of the third embodiment of this invention, with a part of the printing element board shown enlarged. To meet demands for faster printing speed and more vivid, high-quality images, the ink jet print head of recent years often has formed therein nozzles capable of ejecting ink droplets of different volumes. This embodiment is an example wherein the present invention is applied to an ink jet print head having such nozzles with different ejection volumes. In FIG. 10, when the nozzle array A and the nozzle array B have different ejection volumes, the nozzles with the greater ejection volumes are installed in the nozzle arrays A, that are closest to the nozzle drive circuits 44 at both sides of the nozzle array group where the board thickness increases.

In this embodiment the nozzle array A is comprised of nozzles with a droplet ejection volume of 5-7 pl and the nozzle array B is comprised of 1-3 pl nozzles. If ink droplets of 5 pl or more are to be ejected from the nozzle array A, the heat resistors 90 are required to have an area of about 484 $\mu m^2$ or more. If ink droplets of 3 pl or less are to be ejected from the nozzle array B, the heat resistors 91 need to have an area of about 324 $\mu m^2$ or less. Since the amount of heat generated by the nozzle array is almost proportional to the area of its heat resistors, the nozzle array A produces a greater amount of heat than does the nozzle array B. So, putting the nozzle arrays A, which produce a greater amount of heat, on both sides of the nozzle array group and reducing the heat resistance of the beams 43 is effective for efficient heat dissipation. Further, because the amount of heat produced by the nozzle arrays B is relatively small, sufficient heat dissipation can occur without having to make the heat resistance of the beams 45 and 46 as small as that of the beam 43. With this arrangement an ink jet print head has been actualized which has a reduced size and an overall minimal temperature increase in the printing element board and which can eject ink perpendicularly therefrom.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-026170, filed Feb. 6, 2009, which is hereby incorporated by reference herein in its entirety.

What is claimed is:

1. A liquid ejection head comprising:

a plurality of arrays of elements which are formed on one side of a board, which generate energy that is used to eject a liquid, and which are arranged in a first direction;

a plurality of arrays of ejection openings for ejecting liquid which are arranged such that the ejection openings correspond to a plurality of the elements; and a plurality of arrays of supply ports for supplying the liquid to the elements which pierce through the one side and another side of the board and which are arranged in the first direction, wherein the plurality of arrays of supply ports and the plurality of arrays of elements are alternately arranged in a second direction which intersects with the first direction, the plurality of arrays of supply ports include a first array of supply ports arranged at a side of an end of the board in the second direction and a second array of supply ports arranged at a center of the board in the second direction, an interval between the supply ports included in the first array of supply ports is longer than an interval between the supply ports included in the second array of supply ports.

2. The liquid ejection head according to claim 1, wherein a supply port included in the first array of supply ports is rectangular in shape with its longer dimension being in the second direction, and a supply port included in the second array of supply ports is rectangular in shape with its longer dimension being in the first direction.

3. The liquid ejection head according to claim 1, wherein a common liquid chamber connected to the first array of supply ports and the second array of supply ports is formed on the other side of the board.

4. The liquid ejection head according to claim 1, wherein flow path walls are formed between elements of the plurality of arrays of elements.

5. The liquid ejection head according to claim 1, wherein one of the plurality of element arrays is formed near the side of the end of the board adjacent the first array of supply ports.

6. The liquid ejection head according to claim 1, wherein a thickness of the board at a region where the plurality of supply ports is formed is substantially uniform.

7. A liquid ejection head comprising:

a plurality of arrays of elements which are formed on one side of a board, which generate energy that is used to eject a liquid, and which are arranged in a first direction;

a plurality of arrays of ejection openings for ejecting liquid which are arranged such that the ejection openings correspond to a plurality of the elements; and a plurality of arrays of supply ports for supplying the liquid to the elements which pierce through the one side and another side of the board and which are arranged in the first direction, wherein the plurality of arrays of supply ports and the plurality of arrays of elements are alternately arranged in a second direction which intersects with the first direction, the plurality of arrays of supply ports include a first array of supply ports arranged at a side of an end of the board in the second direction and a second array of supply ports arranged at a center of the board in the second direction, and an area of the board between two adjacent supply ports in the first array of supply ports is greater than an area of the board between two adjacent supply ports in the second array of supply ports.

8. The liquid ejection head according to claim 7, wherein a supply port included in the first array of supply ports is rectangular in shape with its longer dimension being in the second direction, and a supply port included in the second array of supply ports is rectangular in shape with its longer dimension being in the first direction.

9. The liquid ejection head according to claim 7, wherein a common liquid chamber connected to the first array of supply ports and the second array of supply ports is formed on the other side of the board.

10. The liquid ejection head according to claim 7, wherein a thickness of the board at a region where the plurality of supply ports is formed is substantially uniform.

* * * * *